United States Patent [19]

Barbieri et al.

[11] 3,941,304

[45] Mar. 2, 1976

[54] CONTAINER FOR A LAMP BULB OR THE LIKE, AND RESULTING PACKAGE

[75] Inventors: Thomas Barbieri, Peapack; Edward J. Getz, Irvington; Alfred W. Wilson, Dover, all of N.J.

[73] Assignee: Westinghouse Electric Corporation, Pittsburgh, Pa.

[22] Filed: Sept. 30, 1974

[21] Appl. No.: 510,826

[52] U.S. Cl. ..... 229/39 B; 206/422

[51] Int. Cl.[2] ..... B65D 5/50

[58] Field of Search ..... 229/39 B; 206/422

[56] References Cited

UNITED STATES PATENTS

| | | | |
|---|---|---|---|
| 2,714,981 | 8/1955 | Leavens | 229/39 B |
| 2,893,623 | 7/1959 | Bates | 229/39 B |
| 3,069,008 | 12/1962 | Dugre | 229/39 B UX |
| 3,162,303 | 12/1964 | Greene | 229/39 B X |
| 3,361,330 | 1/1968 | Arneson | 229/39 B |

FOREIGN PATENTS OR APPLICATIONS

| | | | |
|---|---|---|---|
| 494,639 | 7/1953 | Canada | 229/39 B |

*Primary Examiner*—Davis T. Moorhead
*Attorney, Agent, or Firm*—D. S. Buleza

[57] ABSTRACT

A single lamp bulb is retained within a collapsible open-ended tubular sleeve of stiff paperboard by an integral panel that extends within the interior of the sleeve and has a medial cut-out which interlockingly accommodates a protruding arcuate portion of the lamp bulb. The locking panel is slit, scored and secured to only one of the sleeve walls in such a manner that it automatically flexes and is pushed into locking position when the sleeve is set up for use. The central portion of the panel obliquely spans a corner of the erected sleeve and another portion of the panel frictionally engages and is wedged against one of the sleeve walls to provide a bracing action that inhibits the inherent tendency of the sleeve to return to collapsed condition.

15 Claims, 6 Drawing Figures

CONTAINER FOR A LAMP BULB OR THE LIKE, AND RESULTING PACKAGE

BACKGROUND OF THE INVENTION

1. Field of the Invention:

This invention relates to the packaging art and has particular reference to an improved container for packaging a fragile article such as an electric bulb, and to an improved lamp package which utilizes such a container.

2. Description of the Prior Art

As is well known in the lamp industry, incandescent and other types of lamp bulbs are protected during shipment by inserting the bulb into a wrapper or container of stiff paperboard that is open at both ends and can be collapsed for bulk shipment from the container manufacturer to the lamp factory. Such containers are of tubular configuration and have four walls that make a snug frictional fit with the inserted lamp bulb. In order to prevent the bulb from slipping out of the container and breaking while the lamp package is being handled in the factory or store, it was essential that the interior dimensions of the container be precisely controlled in order to effect the required tight frictional fit with the inserted lamp bulb. Even when the proper fit was obtained, the lamp bulb would still frequently slip out of the container and break, especially if the container was bent out of shape or damaged. It has also been found that the lamp, in transit, will vibrate and cause the fluting to collapse in the maximum diameter area of the bulb. This enlarges the inside dimension of the wrapper and causes the bulb to slip out at the point of sale.

Due to the inherent stiffness of the sheet material from which the sleeve or container is fabricated, such containers also have a natural tendency to return to their collapsed condition even after they have been erected into tubular form and loaded with a lamp bulb. This not only reduced the frictional grip of the container on the inserted bulb but destroyed the "squared-up" configuration of the lamp packages which prevented them from being stacked properly on the store shelves.

A single-lamp open-ended container having a pair of parallel interior panels with openings and hinged tab portions that retain the lamp bulb in its inserted position and lock the sleeve in tubular configuration is disclosed in U.S. Pat. Nos. 3,547,256 and 3,820,707.

Cartons with closure flaps at each end and a hinged internal panel that forms a spaced liner or cell structure which locks the inserted article in position with the carton and spaces it from the carton walls are disclosed in U.S. Pat. Nos. 2,893,623 – 2,764,337 – 2,732,996 – 2,714,981 and 2,611,529.

An open-ended container of corrugated paper having an inwardly-protruding planar tab or brace with a curved edge that interlockingly engages an inserted lamp bulb and retains it in place is disclosed in U.S. Pat. No. 3,162,303.

SUMMARY OF THE INVENTION

In accordance with the present invention the retention of the inserted lamp bulb within the container and the desired squaring-up of the finished packages are both achieved in a very economical and simple manner by employing an additional panel which extends within the open-ended sleeve and is automatically actuated when the sleeve is set up for use. The panel is secured to only one of the four walls of the container and is divided by means of two pairs of score lines and a cut line into a corner-spanning apertured portion, that interlockingly engages the bulbous part of the inserted lamp bulb, and a container-bracing portion that is forced into wedged relationship with the walls of the sleeve in a manner which counteracts the forces operating to return the container to its original collapsed condition. The single additional panel thus serves as an dual-function automatically-actuated component of the sleeve that is incorporated as an integral part of the container with a minimum amount of labor and material.

BRIEF DESCRIPTION OF THE DRAWINGS

A better understanding of the present invention will be obtained from the following description of the exemplary embodiments shown in the accompanying drawings, wherein.

DESCRIPTION OF THE PREFERRED EMBODIMENTS

Figure 1:
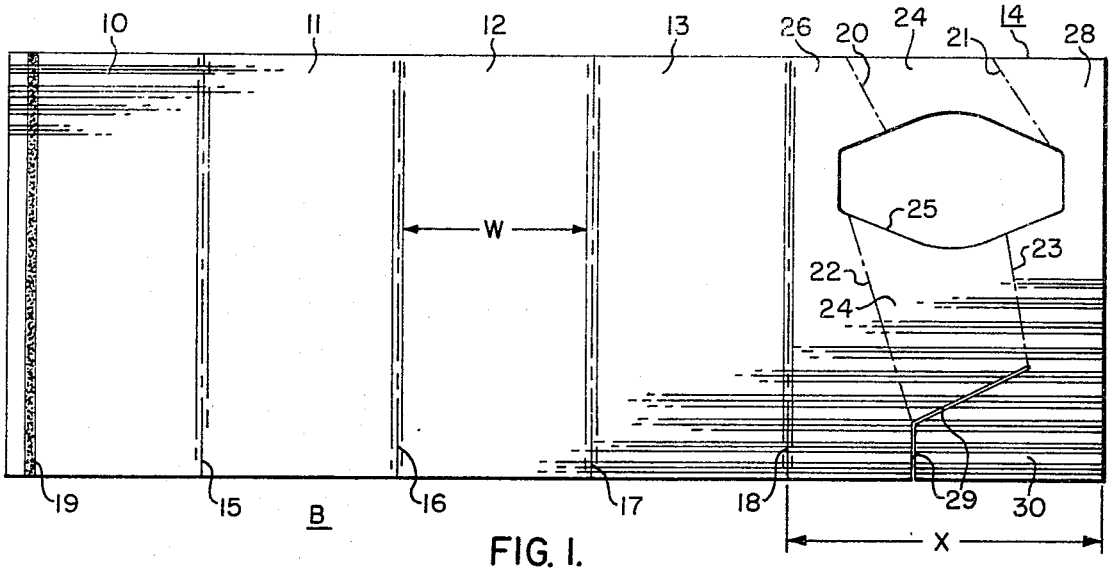
FIG. 1 is a plan view of a precut and prescored blank of corrugated packaging material from which the container of the present invention is preferably formed.

The single-lamp wrapper or container of the present invention is fabricated from stiff sheet material that has the desired cushioning properties and can readily be cut and scored on a mass-production basis. As shown in FIG. 1, it is preferably made from a single piece of single-faced corrugated paper that is cut and scored to form a blank B of the type illustrated. As will be noted, the blank B is divided into four rectangular wall panels 10, 11, 12 and 13 and a locking panel 14 by a series of parallel score lines 15, 16, 17 and 18. The wall panels 10, 11, 12 and 13 are of substantially the same width (dimension *w*) in contrast to the locking panel 14 which has a larger width dimension *x*. All of the panels are of the same length.

Wall panel 10 has a band or strip 19 of suitable glue or other adhesive deposited a small distance inwardly from the end of the blank B to facilitate assembly of the blank into the desired tubular form.

Figure 2:
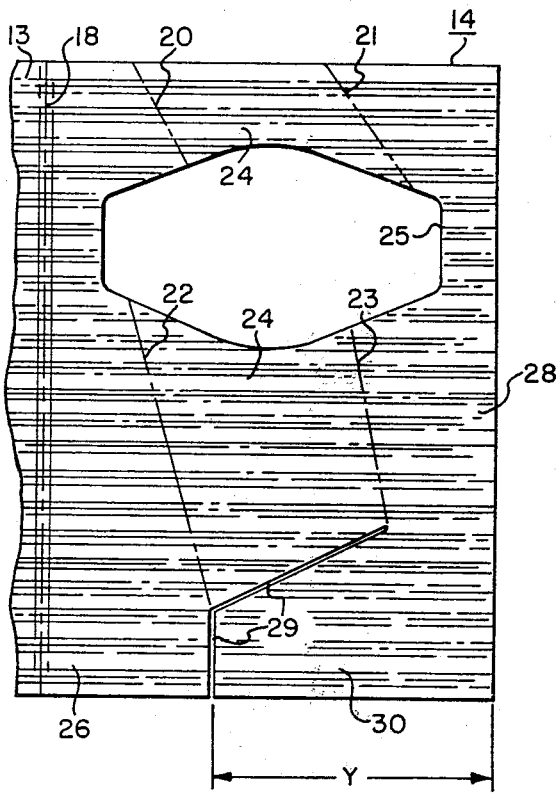
FIG. 2 is an enlarged plan view of the locking panel of the container blank shown in FIG. 1.

As shown more clearly in FIG. 2, the locking panel 14 is sub-divided by a pair of spaced score lines 20, 21 and a second pair of spaced score lines 22, 23 into a central portion 24 and two end portions 26, 28. End portion 26 is hingedly connected by score line 18 to wall panel 13 and end portion 28 constitutes the end of the blank B. A part of the packaging material is removed to provide a cutout or opening 25 that extends transversely across the central portion 24 of the panel 14 and beyond the two sets of paired score lines into the adjacent end portions 26 and 28 of the panel. The opening 25 is positioned adjacent one of the side edges of the locking panel 14 and the associated pair of score lines 20 and 21 extend longitudinally from the opening 25 to the associated side edge of the panel 14. The score lines 20 and 21 are also skewed or angled away from the free end of the panel 14 and are in substantially parallel relationship.

The other pair of score lines 22 and 23 are similarly skewed but at a smaller angle and extend from the opposite side of opening 25 toward the other side edge of the locking panel 14. A cut-line or slit 29 extends inwardly from that side edge of the panel 14 to the end of score line 22 and then transversely to the end of the other score line 23, thus providing a tongue-like segment 30 that is integral with the end portion 28 and extends transversely across the associated edge of the central portion 24 to the other end portion 26 of the panel 14. Slit 29 thus terminates the central portion 24 and the latter is shorter than the end portions 26, 28. The width *y* of the tongue-like segment 30 is equal to or just slightly less than the width *w* of the wall panels 10, 11, 12, and 13.

Figure 3:
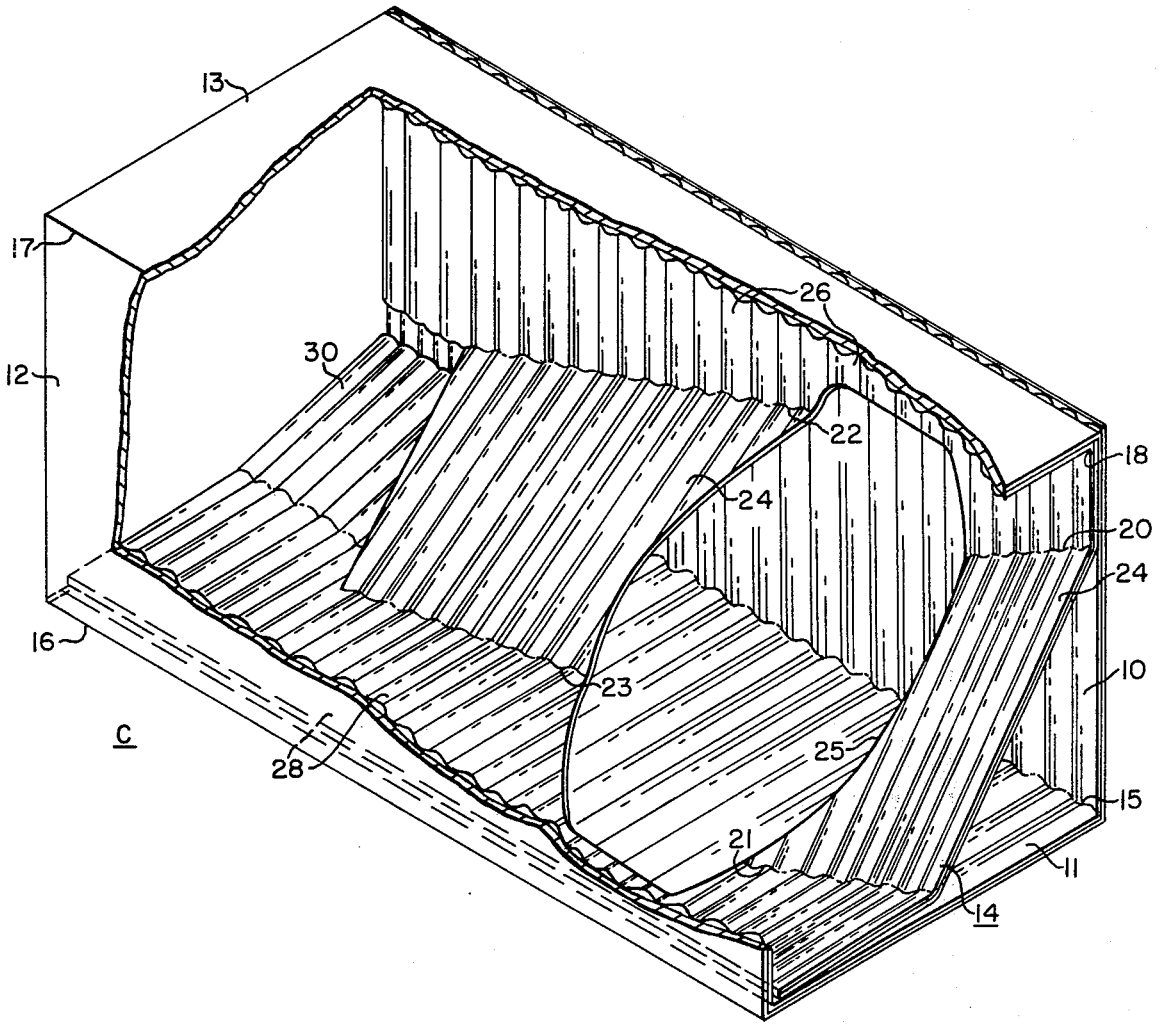
FIG. 3 is a perspective view of the assembled and erected container with the locking panel in bulb-retaining and wall-bracing position, portions of the container being broken away for illustrative purposes.

The blank B is assembled into wrapper or container form by fastening the corrugated surface of wall panel 10 to the smooth non-corrugated surface of the locking panel 14 by means of the layer 19 of glue so that the score line 18 is approximately coincident with the free end of wall panel 10 and the locking panel 14 is located inside of the resulting tubular sleeve or container C shown in FIG. 3. The locking panel 14, accordingly, overlies and is attached to only one wall of the tubular container C. It also extends longitudinally of the container and is so dimensioned that it lies flat between the walls when the container is collapsed along score lines 15, 16, 17 and 18. The resulting container C is thus open at both ends and its inner surface is defined by the corrugated side of the packaging material with the corrugations extending at substantially right angles to the longitudinal axis of the container or sleeve. In FIG. 3 the container C is shown in set-up or erected position with the locking panel in the position which it occupies just before a lamp bulb is inserted into the container.

As will be noted in FIG. 3, the locking panel 14 is of such dimensions and is cut and scored in such a fashion that it automatically flexes along the score lines 20, 21, 22 and 23 when the container C is set up and erected into squared tubular form — thereby causing the end portions 26 and 28 to lie substantially flat against the sleeve walls 10 and 11, respectively, and the central portion 24 to obliquely span the corner that is defined by the adjacent walls 10 and 11. Since the tongue-like segment 30 is not scored and is thus stiff and integral with the glued end portion 28, movement of the panel 14 causes segment 30 to slide along the surface of the sleeve wall 10 and be wedgingly forced into frictional and bracing engagement with this wall and finally come to rest adjacent the corner formed by wall 10 and the adjoining wall 11.

Figure 4:
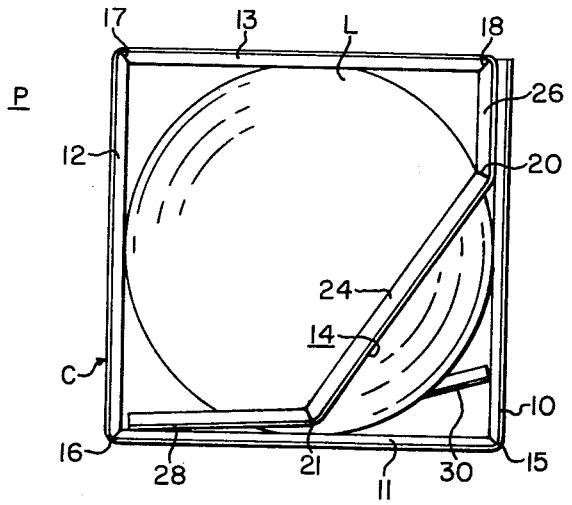
FIGS. 4 and 5 are perspective views into opposite ends of the lamp package that is formed by inserting a lamp bulb into the erected container of FIG. 3.
Figure 5:
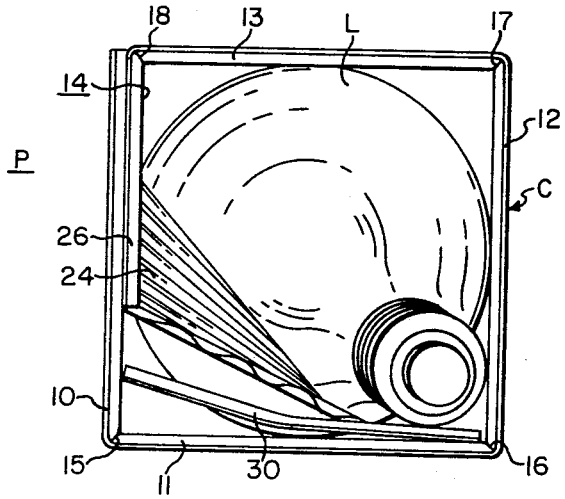

Insertion of a lamp bulb L into the erected container C produces a single-lamp package P of substantially square cross-section such as that shown in FIGS. 4 and 5. As will be noted from FIG. 4, the four walls 10, 11, 12 and 13 of the sleeve snugly and frictionally engage the protruding circular portion of the lamp L and the outermost part of the central portion 24 of the locking panel 14, by virtue of the resiliency of the single-faced corrugated paper, springs back into its corner-spanning position and thus interlockingly engages the bulbous portion of the lamp L which protrudes through the opening 25 in the panel 14. The end portions 26 and 28 of panel 14 both overlie and are substantially seated against the sleeve walls 10 and 11, respectively, with the free end of the locking panel 14 nestingly seated in the corner formed by walls 11 and 12. The tongue-like segment 30 at the opposite end of the container C, on the other hand, is frictionally wedged against wall 10 adjacent the corner defined by this wall and wall 11.

As shown in FIG. 5, the innermost part of the central portion 24 of the locking flap 14 also snaps back into obliquely-spanning relationship with the corner of the container C formed by the walls 10 and 11 and thus interlockingly engages the arcuate shoulder portion of the inserted lamp bulb L adjacent the basal end thereof. While the tongue-like segment 30 of the locking panel 14 is slightly contorted, it is not buckled and is thus firmly wedged between walls 10 and 12 and has its free end disposed at or adjacent to the corner of the sleeve defined by the walls 10 and 11.

The locking panel 14 is thus automatically actuated when the container C is set up for use and produces article-retaining and wall-bracing forces which securely locks the inserted lamp bulb L inside the container and, in conjunction with the loaded bulb, counteracts the inherent tendency of the container C to return to its original collapsed form. Comparative tests have shown that the ability of the container C to retain the loaded lamp bulb L in place is increased by 3 to 4 times that exhibited by a conventional single-faced corrugated wrapper of the same square cross-section and internal dimensions but which does not include the locking panel.

Figure 6:
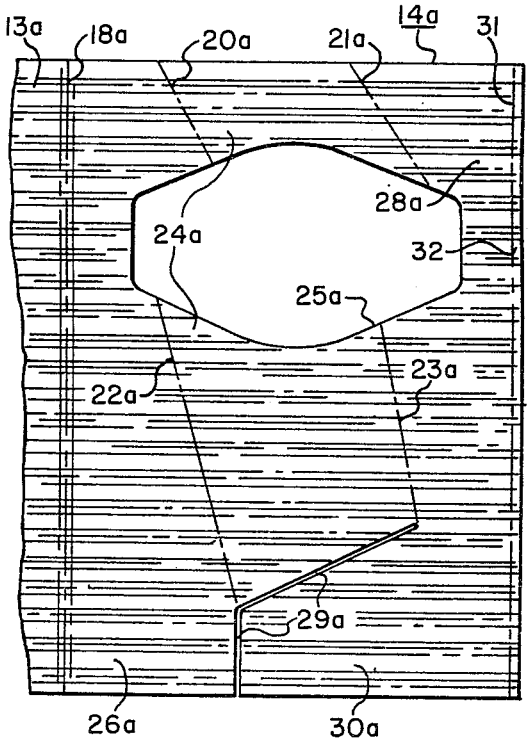
FIG. 6 is an enlarged plan view of an alternative form of integral locking panel.

To facilitate setting-up of the container C into squared configuration, it may be desirable to provide means which will assist the free end of the locking panel to glide into its bracing relationship with the corner of the container. Such means is illustrated in the alternative form of locking panel 14a shown in FIG. 6 and consists of an additional score line 31 that extends along and adjacent to the end edge of the panel. This provides a short flexible lip or tab 32 that can be readily bent and thus permit the the free end of panel 14*a* to glide into the corner of the sleeve when the container is being set-up and squared.

Panel 14*a* is provided with the same type of cutout 25*a*, paired score lines 20*a* – 21*a*, 22*a* – 23*a*, slit 29*a* and tongue-like segment 30*a* previously described.

We claim as our invention:

1. A container for packaging a bulbous-shaped article such as an electric lamp, said container comprising;

four interconnected walls of sheet material that define a collapsible open-ended tubular sleeve which has a longitudinal axis, and integral means for retaining an inserted article in said sleeve and concurrently maintaining the sleeve in erect tubular configuration comprising a hinged panel of sheet material within the sleeve that is flexible along spaced score lines which divide the panel into a central portion and two end portions all of which extend longitudinally of the sleeve, one of said end portions being fastened to one of the sleeve walls and the other end portion and said central portion being unattached and movable with respect to the sleeve walls, a part of the end portion of the panel that is attached to the sleeve wall being separated from the other portions of the panel and constituting a tongue-like segment that extends transversely with respect to the longitudinal axis of the sleeve, the central portion of said panel having a medial opening therein that is adapted to receive the bulbous part of an article that is inserted into the sleeve, said panel being arranged and dimensioned to lie substantially flat within the sleeve when said sleeve is in collapsed condition and then be automatically moved into article-retaining position when the sleeve is erected into its tubular form, said score lines being so oriented that erection of the sleeve causes (a) the free end of the panel to slide along the wall of the sleeve and engage one corner of the sleeve, (b) the two end portions of the panel to lie flat against adjacent side walls of the sleeve that define another corner of the sleeve, (c) the central portion of the panel to obliquely span and thus be spaced from the corner of the sleeve that is defined by the said adjacent walls thereof, and (d) said tongue-like segment to overlie one of the said adjacent walls of the sleeve and be wedged in frictional engagement with the other of the said adjacent walls of the sleeve.

2. The container of claim 1 wherein said panel is of substantially uniform width and has an additional score line that extends along and is disposed adjacent its free end.

3. The container of claim 1 wherein said four walls are of substantially same width and the sleeve is thus of substantially square cross-section when erected and in tubular form.

4. The container of claim 3 wherein the width of said tongue-like segment is substantially the same as the width of the sleeve walls.

5. The container of claim 1 wherein said four walls and panel constitute parts of a single piece of sheet material.

6. The container of claim 1 wherein;

the central portion of the panel is shorter than both of said end portions, and said tongue-like segment is located adjacent and extends along one end of the central portion of said panel when the container is in collapsed condition.

7. The container of claim 1 wherein said sleeve and panel comprise parts of a cut-and-scored blank of single-faced corrugated paper the corrugated side whereof constitutes the inner surface of the sleeve.

8. The container of claim 7 wherein the four walls are of substantially the same length and width and said sleeve is of substantially square cross-section when erected into tubular form.

9. The container of claim 8 wherein;

said panel is generally rectangular, of substantially the same length as the sleeve, and flexible along two pairs of score lines that extend length wise of the panel, one pair of said score lines extending from the medial opening in the central portion to the associated side edge of the panel, and the other pair of said score lines extending from the opposite side of said medial opening toward the other side edge of the panel.

10. The container of claim 9 wherein;

the score lines in each pair of score lines are substantially parallel to one another and skewed away from the free end of the panel, and the pairs of score lines are laterally offset relative to one another.

11. The container of claim 10 wherein;

the tongue-like segment of the end portion of said panel is separated from the rest of the panel by a continuous slit that extends longitudinally from the associated side edge of the panel to the end of the score line of one of said pair of score lines and then extends transversely toward the medial opening in the central panel to the end of the other score line in said one pair of score lines, and a layer of adhesive joins the end portion of the panel to the associated wall of the sleeve.

12. The container of claim 10 wherein;

said panel has another score line therein that is adjacent and extends along the free end of the panel, and said medial opening is located adjacent the side edge of the panel that is opposite the tongue-like segment and said medial opening is elongated in a direction transverse to the longitudinal axis of the sleeve and extends beyond the two pairs of score lines.

13. A package comprising;

a fragile article of elongated configuration that has a bulbous-shaped portion, and a protective container comprising a tubular open-ended sleeve of sheet material that has four interconnected walls, is collapsible, and snugly encloses said article, said sleeve having integral means locking the article within the sleeve and concurrently maintaining the walls thereof in erected relationship comprising a panel of sheet material within the sleeve that is hingedly attached to only one of the sleeve walls and has (a) a central portion that obliquely spans one corner of the sleeve and has a medial opening therein into which the bulbous-shaped portion of the article protrudes, (b) end portions that overlie adjacent walls of the sleeve which define the spanned corner of the sleeve, and (c) a tongue-like segment that extends from the spanned corner of the sleeve to the oppositely-disposed wall of the sleeve and is of such length that said segment is frictionally wedged against said oppositely-disposed wall and serves as a brace that inhibits the tendency of the sleeve to collapse, said locking panel being divided into said central and end portions and said tongue-like segment by two pairs of score lines which extend longitudinally from opposite sides of said medial opening in the central portion of the locking panel toward the respective open ends of the sleeve, and by a slit that longitudinally extends from an outer edge of the locking panel to one score line in one of said pairs of score lines and then extends transversely to the other associated score line.

14. The package of claim 13 wherein;

said article comprises an electric lamp bulb, and said sleeve and locking panel constitute parts of a single piece of sheet material.

15. The lamp package of claim 14 wherein said piece of sheet material comprises a cut-and-scored blank of single-faced corrugated paper the corrugated side whereof constitutes the inner surface of the sleeve.

* * * * *